US006145764A

United States Patent [19]

Gonzalez et al.

[11] Patent Number: 6,145,764

[45] Date of Patent: Nov. 14, 2000

[54] REPLACEABLE TIP FOR A NOZZLE

[75] Inventors: Daniel Gonzalez, East Earl; James W. Smith, Reading; Donald R. Rutherford, Honey Brook, all of Pa.

[73] Assignee: RV Industries, Inc., Honey Brook, Pa.

[21] Appl. No.: 09/430,523

[22] Filed: Oct. 29, 1999

[51] Int. Cl.[7] ..... B05B 15/08; F23D 1/00

[52] U.S. Cl. ..... 239/587.6; 239/600; 110/261; 110/263

[58] Field of Search ..... 239/600, 587.6, 239/587.5, 587.1, 1; 110/264, 263, 261

[56] References Cited

U.S. PATENT DOCUMENTS

| | | |
|---|---|---|
| 2,895,435 | 7/1959 | Bogot et al. . |
| 3,823,875 | 7/1974 | Bauer et al. . |
| 4,356,975 | 11/1982 | Chadshay . |
| 4,459,922 | 7/1984 | Chadshay . |
| 4,520,739 | 6/1985 | McCartney et al. . |
| 4,836,772 | 6/1989 | LaRue . |
| 4,934,284 | 6/1990 | Nitz et al. . |
| 5,215,259 | 6/1993 | Wark . |
| 5,435,492 | 7/1995 | Tenerowicz . |
| 5,461,990 | 10/1995 | Newman . |

*Primary Examiner*—Lesley D. Morris
*Attorney, Agent, or Firm*—Howson & Howson

[57] ABSTRACT

A nozzle assembly includes a readily replaceable nozzle tip which is replaced within a firnace adjacent an installed furnace-side end of a supply nozzle. The nozzle tip is provided with a pair of opposed, spring-loaded pivot pins which snap into apertures in the wall of a stationary nozzle conduit to removably secure the tip to the conduit. The pivot pin connection permits tilting of the tip relative to the stationary conduit in a vertical plane about a horizontal axis extending through both pivot pins. A link arm used for tilting the nozzle tip has a hook-shaped end which connects to a pin extending from the nozzle tip. The hook-shaped end of the link arm permits removal of the nozzle tip without having to remove the link arm from a lever assembly.

23 Claims, 5 Drawing Sheets

REPLACEABLE TIP FOR A NOZZLE

BRIEF SUMMARY OF THE INVENTION

This invention relates to a replaceable tip used to control the direction of discharge of a stream of material from a nozzle. More particularly, the invention elates to an improved nozzle tip capable of being quickly and easily installed on the stationary portion of a nozzle. The invention has particular utility in coal fired-furnaces, of the kind used by electric utilities for steam generation, where nozzle tips wear rapidly and must be replaced from time to time.

A nozzle used to project a stream of pulverized coal and air into the combustion chamber of a coal-fired furnace is usually very large and heavy. It comprises a stationary conduit and a tip. The conduit typically weighs about 1000 pounds, while the tip typically weighs well over 100 pounds. The tip is ordinarily pivoted at the discharge end of the stationary conduit so that direction in which the supply of pulverized coal and air is discharged into the combustion chamber can be adjusted for control of temperature. The stationary conduit of the nozzle may be lined with ceramic and will typically last ten or more years without requiring replacement. However, because a nozzle tip is exposed to high temperature and abrasion, it requires more frequent replacement, typically at two year intervals.

In a typical installation, the stationary conduit of the nozzle is encased in a cover plate and is attached to coal piping by a coupling such as a victaulic coupling. The tip is mounted to the furnace-side discharge end of the stationary conduit by a pair of pivot pins. The pivot pins are inserted from outside the tip, through the tip, and into the stationary conduit, and are welded into place. The pivot pins are aligned with each other, usually along a horizontal pivot axis, so that the pivoting movement of the nozzle tip takes place in a vertical plane. The pivoting movement is controlled by a link arm having an end attached to a link pin which is welded to the tip. The link arm extends rearward from the nozzle tip, and its opposite end is bolted to a lever assembly, which may control the pivoting of several nozzles in a column simultaneously.

The stationary nozzle is usually one of several nozzles located in a column, one above another, in a structure known as a "windbox." Each such stationary nozzle is usually located within a compartment defined by compartment plates and a rear cover plate.

The replacement of a worn nozzle tip typically requires 16 or more man-hours, and includes various time-consuming steps. For example, the victaulic coupling must be unbolted, and the coal piping and rear cover plate must be disconnected from the stationary conduit and from the windbox to provide a rear opening. The link arm must be disconnected from the lever assembly, and the tip, link arm and stationary conduit must be removed through the rear opening in the windbox. The pivot pins and link pin must be burned out, and a new nozzle tip and a new pair of pivot pins must be welded to the stationary conduit. The link arm must be welded to the new nozzle tip, and the nozzle tip, link arm and stationary conduit must be returned to the windbox. The link arm must be reconnected to the lever assembly, and the cover plate, coal piping and victaulic coupling must be re-attached to the stationary conduit.

In most cases, a structure known as a "seal plate" is provided at the front end of the stationary conduit to keep air from the windbox from flowing directly into the portion of the nozzle tip which receives coal from the stationary conduit. The seal plate is pivoted on the two pivot pins, and has holes through which the pivot pins extend. Alignment of the holes in the seal plate with the pivot pins also gives rise to some difficulties during assembly of the nozzle structure.

Because of the many difficult steps required in the replacement of a nozzle tip, there is a need for an improved nozzle tip which can be replaced with substantially less time and effort.

Various nozzles are known in the prior art. For example, U.S. Pat. No. 5,215,259, to Wark, discloses a coal nozzle tip which is replaceable in a minimum amount of time from the inside of the combustion chamber of a furnace. The tip is slid into position on the nozzle and is interconnected thereto by the use of cooperating slots and locking tabs, or keys, which are welded together. See the Wark patent at column 4, line 67, to column 5, line 7.

U.S. Pat. No. 5,435,492, to Tenerowicz, discloses a coal nozzle tip replaceable from a location inside a furnace without requiring complete disassembly of the entire nozzle. The tip is pivoted about a pair of coaxial pins which extend transversely through the tip wall and are welded to the front of the nozzle.

U.S. Pat. No. 4,520,739, to McCartney et al., discloses a three-piece coal nozzle tip which is held together by connector bolts. The pieces of the tip are individually replaceable from the interior of the firnace without detaching the entire nozzle tip body from the coal delivery pipe.

U.S. Pat. No. 3,823,875, to Bauer et al., discloses a two-piece coal nozzle tip which is installed within a furnace. The inner and outer shells of the tip are connected together by mating ribs and tip supporting rods which are inserted through aligned apertures. The shells are provided with other aligned apertures to which a link arm is attached.

U.S. Pat. No. 5,461,990, to Newman, discloses a quick disconnect mounting and link system for mounting a nozzle in pivotal movement relative to a furnace. A link, having a transversely extending pin, extends from the nozzle tip and is connected to a center arm of a linkage system via a cooperating slot-and-pin engagement. Thus, as stated in Newman at column 4, lines 55–57, the slot in the center arm allows the burner to be removed and installed without disassembling its associated linkage mechanism.

U.S. Pat. Nos. 4,356,975 to Chadshay, 2,895,435 issued to Bigot et al., 4,459,922 issued to Chadshay, 4,836,772 issued to LaRue, and 4,934,284 issued to Nitz et al. disclose other nozzle tips known in the art.

In most cases, where provision is made for replacement of a nozzle tip from inside the furnace, only a portion of the nozzle tip is replaced. Where the entire nozzle tip is replaceable, the procedure is generally complex and time-consuming, and difficulties are encountered in gaining access to the link arm that controls the tilting of the nozzle tip, and in disconnecting and reconnecting the link arm.

Thus, although the aforementioned nozzle assemblies and nozzle tip installation and replacement procedures may be satisfactory for their intended purposes, there is a need for an improved nozzle tip which makes rapid tip replacement possible. In addition, an improved method of replacing a worn nozzle tip which significantly reduces the amount of labor required is desirable. Preferably, the replacement procedure should not require the removal or handling of the main nozzle conduit or the coal piping and should not require the removal of the link arm from the lever assembly. The entire replacement procedure should require no more than about one man hour of labor.

Therefore, the principal object of this invention is to provide a novel nozzle tip structure which, when new, can be quickly installed on a pre-existing stationary conduit and, when worn, can be readily removed. It is also an object to provide a method of replacing a nozzle tip which significantly reduces the labor required for maintenance of the associated furnace.

The invention addresses the foregoing objects by providing a replaceable nozzle tip having a collar with a pair of opposed, spring-loaded pivot pins which are resiliently biased, preferably radially inwardly. The term "radially inward" refers to a direction toward the centrally located axis of the nozzle, which extends in a the direction of flow. The spring loaded pivot pins are capable of removably securing the tip to a stationary conduit of the nozzle in a manner which permits pivoting of the tip relative to the stationary conduit. Each of the spring-loaded pivot pins is also capable of being urged radially outward so that the collar can be telescopically positioned on, or removed from, the stationary conduit.

According to another aspect of the present invention, a method of installing a replaceable tip on an existing stationary conduit is provided. The stationary coal conduit is pre-installed in a furnace and has a furnace-side end defining a discharge port within the furnace. The replaceable tip is located within the firnace adjacent the furnace-side end of the pre-installed stationary coal conduit. The tip has a pair of opposed, radially inward-extending, spring-loaded pivot pins which are resiliently biased in a radially inward direction. The tip is telescopically positioned on the furnace side end of the pre-installed stationary coal nozzle, and the spring-loaded pivot pins are urged radially outwardly so that the tip is capable of being further advanced telescopically onto the furnace side end of the pre-installed stationary coal nozzle until the spring loaded pivot pins snap inwardly into apertures formed in the sidewall of the stationary coal nozzle. The nozzle tip may be removed by a similar method, in which the spring-loaded pins are urged outwardly to release them from the apertures in the sidewall of the stationary coal nozzle.

DETAILED DESCRIPTION

Figure 1:
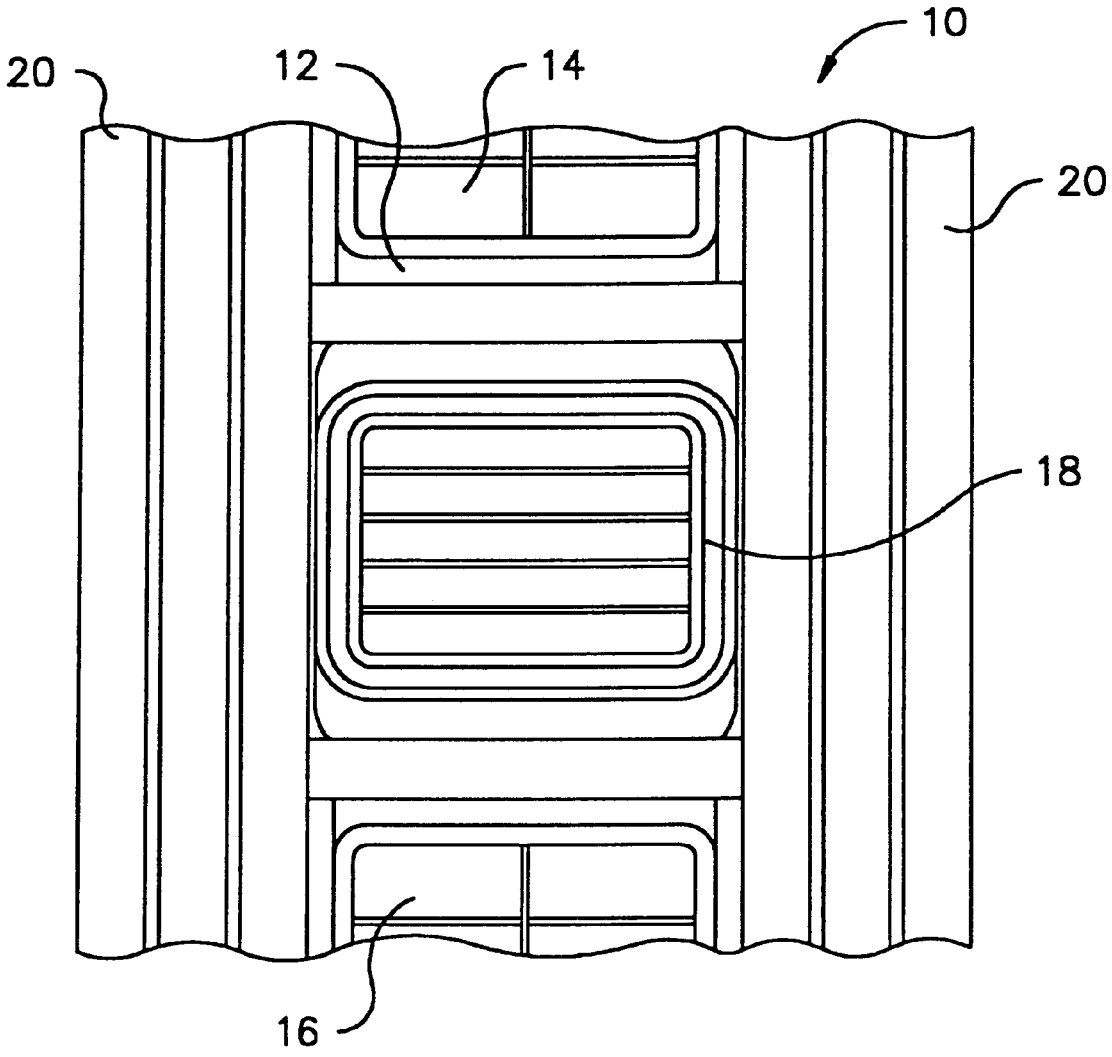
FIG. 1 is an elevational view of a portion of a wall of a combustion chamber of a coal-fired furnace in which a nozzle tip according to the invention is installed.

As illustrated in FIG. 1, steam generating units are provided with furnaces 10 having walls 12 through which a combustible fuel-air mixture is supplied. For instance, the vertically-aligned and spaced-apart nozzles 14 and 16 illustrated in FIG. 1 discharge a flow of air above and below a fuel-air mixture discharged by a centrally-located nozzle 18. The heat from the products of combustion in the furnace 10 is absorbed by boiler water circulating in tubes 20, in which steam is generated.

Figure 2:
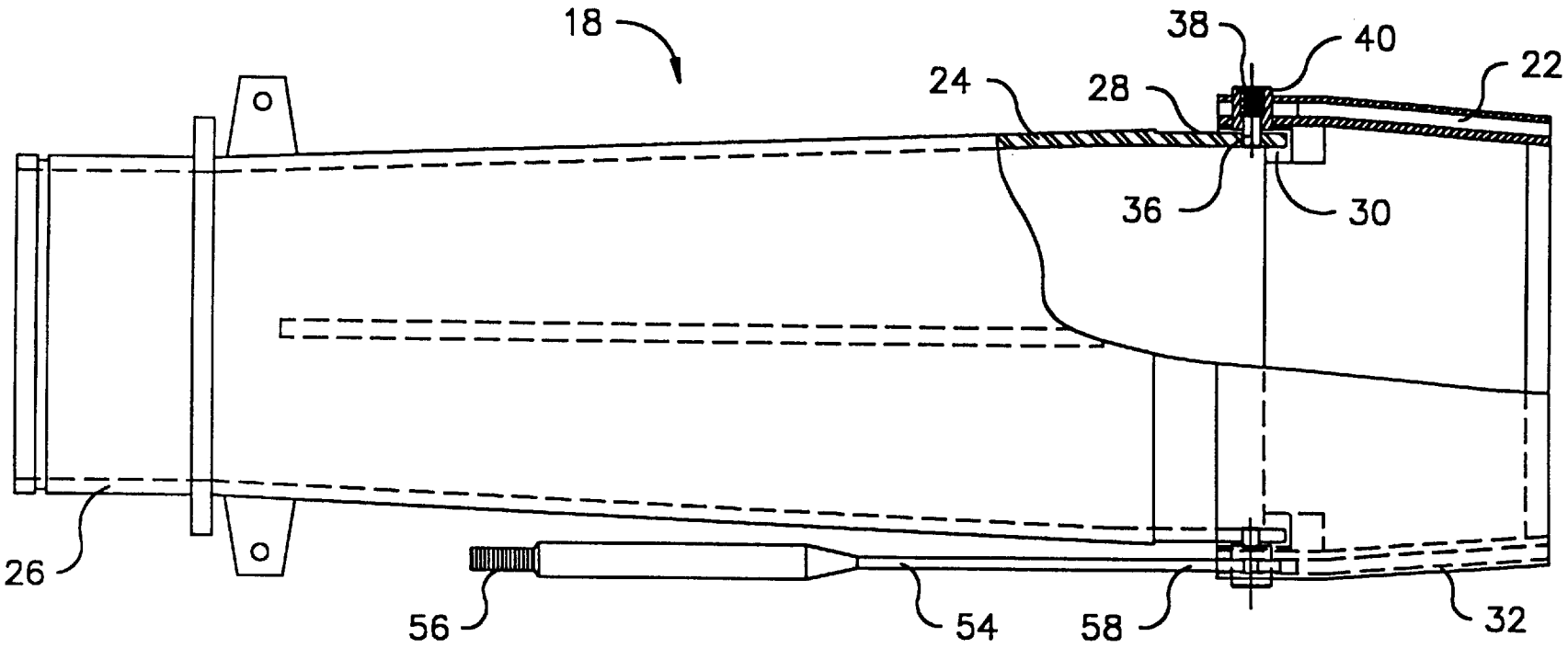
FIG. 2 is a top plan view of a coal nozzle assembly according to the invention, a portion of the view being cut away to show the nozzle tip assembly.
Figure 4:
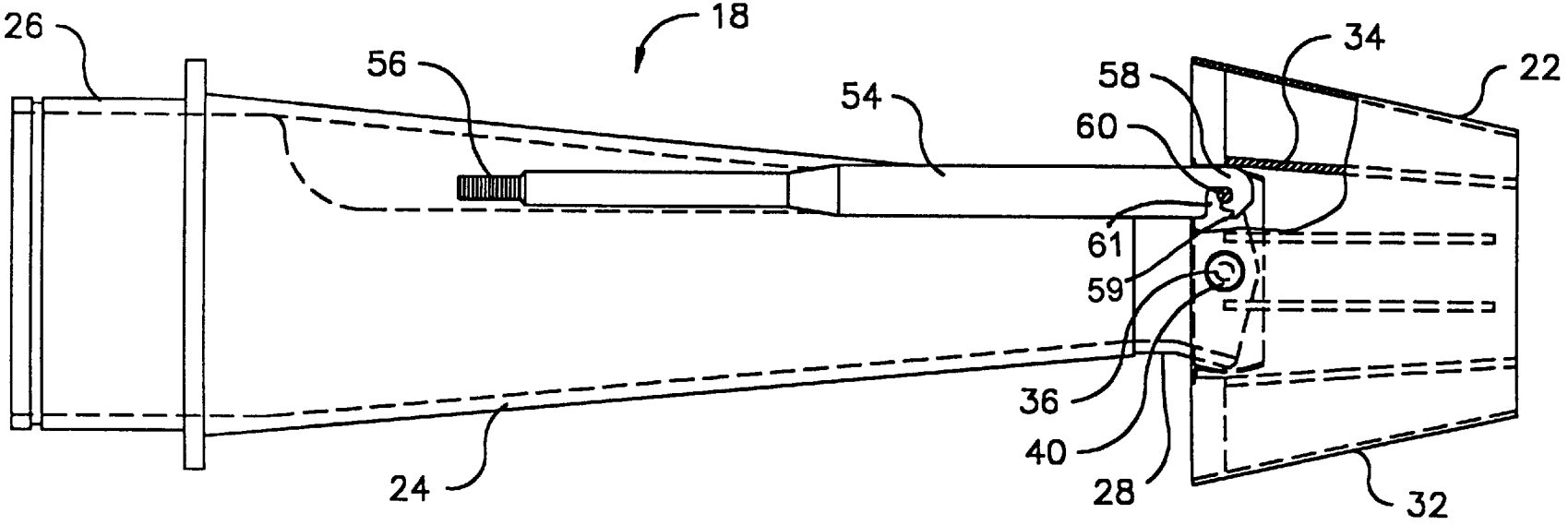
FIG. 4 is a side elevational view of a coal nozzle and link arm assembly according to the invention, a portion of the view being cut away to show the link arm connection.

As best illustrated in FIGS. 2 and 4, the nozzle 18 includes an elongate, heavy, stationary, main conduit portion 24 and a tip 22 which is tiltable relative to the conduit 24. The ability of the tip 22 to tilt permits the direction of discharge of the fuel-air mixture to be controlled which, in turn, controls the temperature within the furnace 10. Preferably, the tip 22 is tiltable in a vertical plane.

The nozzle 18, and more particularly the nozzle tip 22, of the invention is suited for use in a coal-fired furnace to deliver a stream of pulverized coal and air to the furnace 10. However, while the nozzle tip 22 disclosed herein is used in a coal-fired furnace, the tip 22 can also be utilized in other furnaces and other equipment which require a tiltable supply nozzle. Thus, the invention is not limited solely to use in coal-fired furnaces.

The nozzle tip 22, especially when utilized in a coal-fired furnace, is subjected to a harsh enviromnent and ordinarily becomes worn and requires replacement more frequently than the stationary nozzle conduit 24. Thus, throughout the useful life of a stationary nozzle conduit 24, the nozzle tip 22 will be replaced many times. Therefore, as previously stated, it is desirable that the nozzle tip replacement require a minimum of labor to reduce furnace downtime.

As best illustrated in FIGS. 2 and 4, the stationary conduit 24 has an end 26 which is connected to coal piping (not shown) and which receives a supply of pulverized coal. The conduit 24 also has a furnace-side end 28 which defines a discharge port for supplying the stream of pulverized coal and air to the furnace. The nozzle tip 22 has a seal plate, or collar, 30 which engages the furnace-side end 28 of the stationary conduit 24. To this end, the seal plate 30 is telescopically received on the end 28 so that the seal plate is concentrically seated on and surrounds the conduit end 28. The nozzle tip 22 also includes a tapered outer wall 32, an inner wall 33 spaced from the outer wall, and horizontally-disposed baffles 34 which extend forward into the furnace from the end 28 of the stationary conduit 24 and which direct the pulverized coal and air mixture. Preferably, the seal plate 30, outer tapered wall 32 and baffles 34 are made of a fabricated material or a cast material.

One of the novel features of the invention is that a pair of spring-loaded pivot pins 36 are utilized to secure the nozzle tip 22 to the stationary conduit 24. As best illustrated in FIG. 2, the pins 36 extend radially inward relative to the seal plate 30 and stationary conduit 24, and are directly opposed to each other to permit pivoting of the tip 22 about an axis extending through the opposed pins 36. Preferably, as illustrated, the pins 36 are disposed horizontally so that the nozzle tip 22 pivots in a vertical plane.

A unique aspect of the pivot pins 36 is that each is resiliently biased inward by springs 38. To this end, a pair of diametrically opposed, cylindrical, hollow bushings 40 extend radially through the outer wall 32 and through holes in the sides of the seal plate. The seal plate 30 is therefore supported by, and rotatable on, the bushings 40. The bushings house the spring means 38, and at least the head portion **36*a* of the pivot pins 36. Thus, there is provided an integral replaceable nozzle tip unit 22, which includes the tip outer wall and baffles, the bushings, the spring-loaded pivot pins and the seal plate, all of which can be installed as a unit on the stationary nozzle. The nozzle tip 22** can be constructed as a multiple part assembly as disclosed in the previously referenced prior art patents.

The fact that the bushings extend a short distance inwardly from the inner wall of the nozzle tip has two important advantages. First, it provides support of the seal plate eliminating, seal plate alignment problems. Second, the resulting additional length of the bushings provides more space inside the bushings for the springs.

Figure 3:
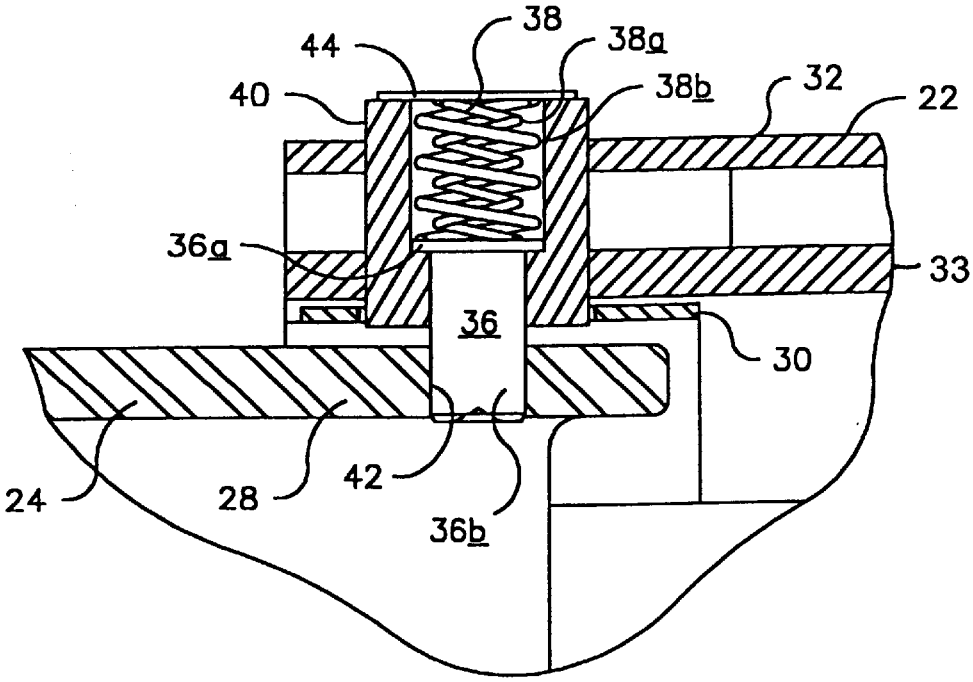
FIG. 3 is a cross-sectional view of the spring-loaded pivot pin and nozzle assembly according to the invention.

As best illustrated in FIG. 3, the spring-loaded pivot pins 36 secure the nozzle tip 22 to the stationary conduit 24 by extending into apertures 42 formed in the tubular sidewall of the stationary conduit 24 at a location spaced from the discharge opening defined by the furnace-side end 28 of the stationary conduit. Each captured spring 38 is positioned between an outer end wall 44 of one of the bushings 40 and the head portion 36*a* of one of the pins 36. Thus, the springs 38 apply a force to the pins 36 to urge the pins toward each other in a radially inward direction so that the shafi portions 36*b* of the pins 36 snap into the apertures 42 and are not released from the apertures 42, except during replacement as will be discussed. Preferably, as illustrated, each spring 38 comprises a pair of concentrically-positioned, oppositely-wound, helical springs 38*a* and 38*b*. The spring material should be such that it does not lose its resilience at high temperatures. 17-7 stainless steel, Inconel 600 or Inconel 750 are suitable. 17-7 stainless steel is capable of withstanding temperatures up to about 650° F., while Inconel 600 and Inconel 750 are capable of withstanding temperatures up to approximately 700° F. and 1100° F. respectively. The spring modulus of the combined, oppositely wound springs, is preferably such that a force of about 50 to 70 pounds is required to cause the pins 36 to clear apertures 42. Other known equivalent devices, of course, can be used for resiliently urging the pins 36 radially inward.

The springs, of course, are under relatively little compression when the pins 36 are in their extended condition, holding the nozzle tip in place on the stationary nozzle. Therefore, even if deterioration of the springs' resilience occurs as a result of prolonged operation at high temperatures, there is almost no likelihood that the pins will become disengaged from the nozzle tip unintentionally.

Figure 5:
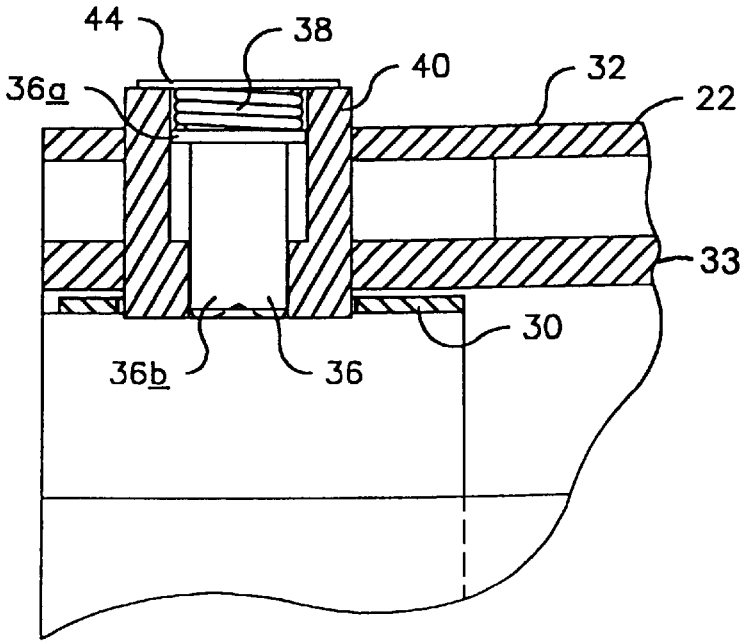
FIG. 5 is a cross-sectional view of the spring-loaded pivot pin in an outwardly urged position.

The spring-loaded pivot pins 36 enable the nozzle tip 22 to be readily installed on, or removed from, the stationary conduit 24. As best illustrated in FIG. 5, during installation or removal, the pivot pins 36 can be urged radially outward to compress the springs 38 and to cause the inwardly extending shaft 36*b* of each pin 36 to retract completely within its associated bushing 40. With the pins in this retracted position, the combination of the sealing plate 30 and the nozzle tip 22 can be slid onto the furnace-side end 28 of the stationary conduit 24, or slid off of the furnace-side end 28 of the stationary conduit 24. Thus, a worn tip can be removed without requiring welds to be burned free, and a new tip can be installed without having to be welded to the stationary conduit 24.

Figure 6:
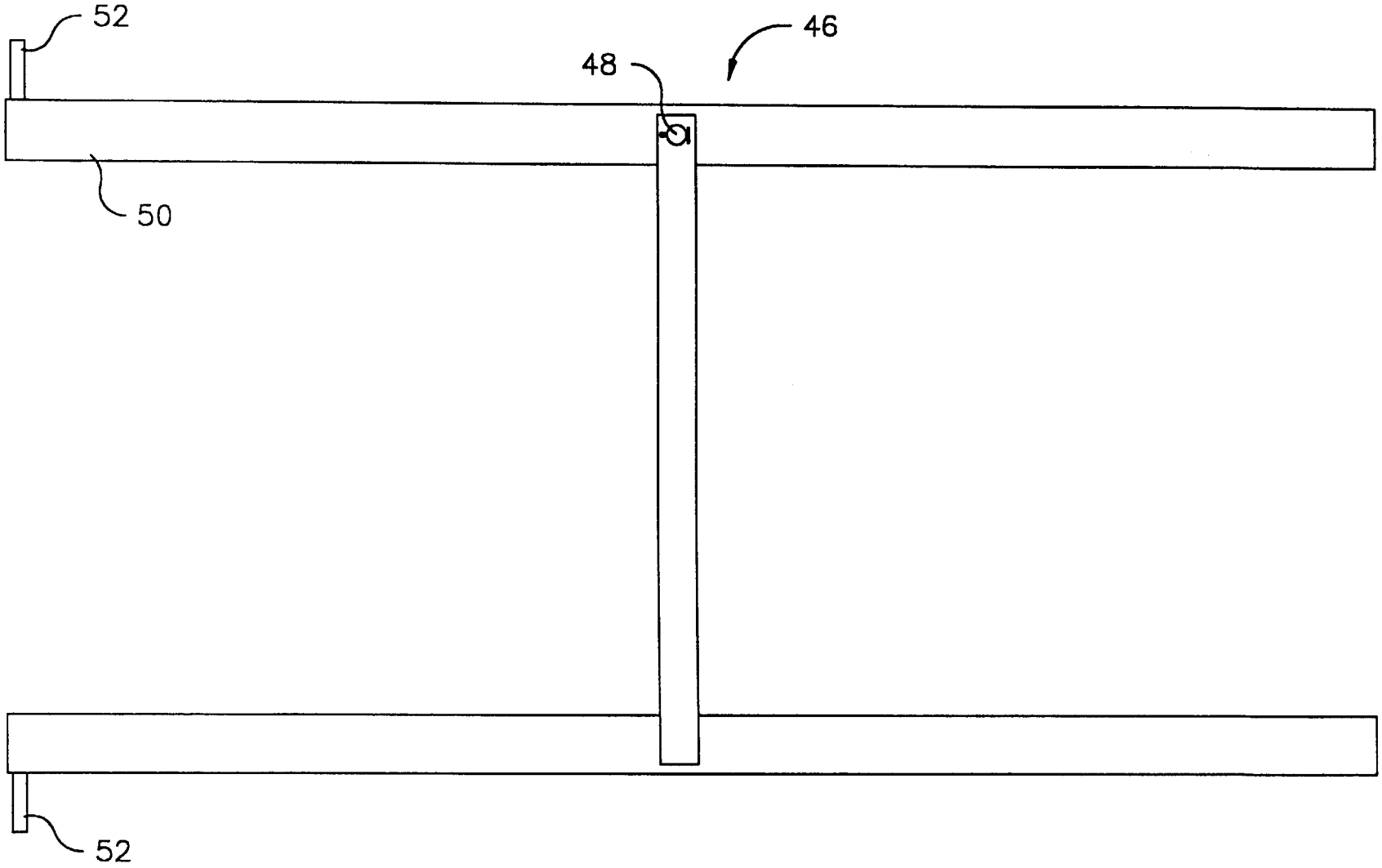
FIG. 6 is a plan view of a spreader tool utilized to urge the spring-loaded pivot pins in a radially outward direction.

An example of a spreader tool 46 utilized to engage the pins 36 and urge them radially outward is illustrated in FIG. 6. The tool 46 is pivoted about a joint 48 which enables the distal end 50 of the tool 46 to spread open or close inwardly. The distal end 50 has a pair of outwardly-extending pin engaging projections 52. When the projections 52 are positioned into engagement with the inwardly extending pins 36, the tool 46 can be pivoted to spread open the distal end 50 and to urge the pins 36 in an outward direction. After the pins 36 are forced into their bushings by the tool 46 and as the nozzle tip 22 is being slid onto, or off of, the stationary conduit 24, the solid wall of the stationary conduit 24 prevents the pins 36 from snapping inwardly until, of course, the pins 36 are aligned with apertures 42, or until the pins are slid completely past the terminal end of the furnace-side end 28 of the stationary conduit 24.

Another important aspect of the nozzle 18 according to the invention is the use of a link arm having a hook-shaped end which can readily be attached to, and disengaged from, the nozzle tip 22. As best illustrated in FIG. 4, the elongate link arm 54 has an end 56 which is connected to a lever assembly (not shown) and an opposite end 58 which is connected to the nozzle tip 22. The link arm 54 is utilized to tilt the nozzle tip in a vertical plane about a horizontally-disposed pivot axis extending through the pivot pins 36. Thus, if the link arm 54 is moved to the left in FIG. 4, the nozzle tip 22 will be tilted upward, and if the link arm 54 is moved to the right in FIG. 4, the nozzle tip 22 will be tilted downward.

The nozzle tip 22 is provided with a pin 60 which extends between its inner and outer walls and is removably engageable by link arm end 58. As illustrated, link arm end 58 has an open hook shape which can hook onto the pin 60 and be retained there without the need for a welded connection. The hook-shaped end 58 opens downwardly so that the pin 60 is captured by the link arm 54, supports the weight of the link arm 54, and prevents unintended disengagement during normal operation. However, during nozzle tip replacement, the link arm 54 is disengaged from the pin 60 by being lifted in an upward direction to release the pin 60. Likewise, the link arm 54 is engaged with the pin of a new tip by being downwardly directed onto the pin. Thus, during replacement, it is not necessary to remove a cover plate to gain access to the link arm from the exterior of the windbox. In addition, it is unnecessary to disconnect the link arm 54 from the lever assembly.

Another aspect of the invention is a method for installing and removing the above-described nozzle tip 22. The method requires only a minimum of labor and allows installation or removal of the nozzle tip to be accomplished in approximately one-man hour or less. An advantage of the method of the invention is that it eliminates the need to: disassemble and re-assemble the victaulic coupling, coal piping and cover plate from the stationary nozzle conduit 24; disengage and re-engage the link arm 54 and lever assembly connection; remove and re-install the link arm 54 and stationary nozzle conduit 24; and burn out the old welds and form new welds for the pivot pins and link arm.

The nozzle tip 22 of the invention is installed on a stationary conduit 24 which has been previously installed within a furnace. Thus, the heavy and bulky stationary nozzle conduit 24 does not require removal, handling or disconnection from the coal piping and surrounding cover plate. Rather, the installation of the nozzle tip 22 is accomplished within the furnace adjacent the furnace-side end 28 of the installed stationary conduit 24. Thus, the first step in the installation is to locate a replacement nozzle tip 22 within the furnace adjacent the furnace-side end 28.

The nozzle tip 22 is lifted and the sealing plate 30 is telescopically slid and positioned onto the furnace-side end 28 of the stationary conduit 24. The inwardly extending pivot pins 36 prevent the sealing plate 30 from being fully advanced onto furnace-side end 28. Thus, before the nozzle tip 22 can be properly seated on the stationary conduit 24, the spring-loaded pivot pins 36 must be forced in an outward radial direction, using a tool such as the spreader tool 46, so that the nozzle tip 22 can be further telescopically advanced onto the furnace side end 28 of the stationary nozzle conduit 24. Thereafter, when the spring-loaded pins 36 are aligned with the apertures 42 in the wall of the stationary conduit 24, the spring-loaded pivot pins snap inwardly into the apertures 42 and secure the nozzle tip 22 to the stationary conduit 24.

Another step, which is accomplished after the nozzle tip 22 has been secured to the stationary conduit 24, is to connect a previously installed link arm 54 to the nozzle tip 22. During the nozzle tip 22 installation, the hook-shaped end 58 of the link arm 54 is lifted upward from its normal position so that it does not interfere with the installation of the nozzle tip 22. A wire or flexible cord (not shown) is passed through the space between the inner and outer walls of the nozzle tip, and over a pin 60, which extends horizontally between the inner and outer walls of the nozzle tip 22. A loop at the end of the wire or cord is engaged with a small notch 59 adjacent to the end of the link arm and forward of the larger, downwardly open notch 61, which is in the form of an inverted "J". This J-shaped notch is for engagement with the pin 60. By manually pulling on the wire or cord, the link arm can be lifted and held in a raised position as the nozzle tip is translated or tilted rearwardly. With the link arm held in the raised position, rearward translation or rearward tilting of the nozzle tip causes pin 60 to engage a chamfer on the lower part of the tip of the link arm, whereupon further rearward translation or tilting movement cams the link arm upward so that slides over the pin, and the pin enters the J-shaped notch. The link arm can be lifted by the cord or wire either before or after the pivot pins 36 snap into the holes 42 near the discharge end of the stationary nozzle. If the link arm is to be lifted after the pivot pins snap into holes 42, the nozzle tip may be tilted downwardly, or the tilting control lever assembly operated, so that the end of the link arm will clear pin 60. When the notch and pin are in alignment, the link arm falls by gravity, and the pin becomes engaged with the notch. When the nozzle tip is released, its weight causes it to tilt downwardly, so that the pin 60 enters the forwardly extending, end portion of the J-shaped notch. The weight of the nozzle tip and the shape of the notch together ensure that the pin 60 will remain engaged with the link arm under normal operating conditions.

When it is worn, the nozzle tip 22 can be removed without the need for removal and handling of the heavy stationary conduit 24. First, the link arm is disconnected from the nozzle tip by passing a rigid bar or similar narrow tool through the space between the inner and outer walls of the nozzle tip and engaging the bar or tool with the underside of the end of the link arm. The link arm is pushed upward while the nozzle tip is tilted rearward, causing the pin 60 to disengage the J-shaped notch in the link arm.

After the link arm 54 is disengaged from the nozzle tip, the spring-loaded pivot pins 36 may be urged radially outwardly until they are completely clear of the apertures 42 in the wall of the stationary conduit 24. At this time the nozzle tip 22 can be withdrawn from the furnace side end 28 of the installed stationary conduit 24. Alternatively, the nozzle tip can be removed by cutting it apart, using a plasma torch or other suitable cutting device.

The above-described nozzle, particularly the replaceable tip, and the above described method of its installation and removal enable the replacement of a coal nozzle tip to be performed relatively easily and quickly. The tip can be installed quickly on any of various new or existing stationary coal nozzles. The link arm can be readily and easily installed and removed without the need for access to the link arm from outside the combustion chamber of the boiler.

Various modifications to the nozzle tip are contemplated. For example, the tip can be made of fabricated material or cast material, and the tip can be provided as one unitary part or as an assembly of multiple, separable parts. In addition, the tip can be utilized on any type of supply nozzle, and is not limited merely to coal supply nozzles.

Other modifications, alterations, and changes may be made without departing from the spirit and scope of the invention as defined in the appended claims.

We claim:

1. A replaceable nozzle tip assembly for a stationary nozzle, comprising a collar having a pair of opposed, radially extending, spring-loaded pivot pins which are resiliently biased radially by a biasing force and which are capable of removably connecting said replaceable nozzle tip to the stationary nozzle and to permit pivoting of said replaceable nozzle tip relative to the stationary nozzle, each of said spring-loaded pivot pins being capable of being urged radially against the biasing force so that said collar is capable of being installed on, and removed from, the stationary nozzle.

2. A replaceable nozzle tip assembly according to claim 1, wherein said spring-loaded pivot pins extend, and are resiliently biased, radially inward.

3. A replaceable nozzle tip assembly according to claim 1, wherein said collar has a radially extending link pin; and further comprising a link arm which is capable of being removably secured to said collar for pivoting said replaceable nozzle tip relative to the stationary nozzle, said link arm having a hook-shaped end which is removably engageable with said link pin.

4. A replaceable nozzle tip assembly according to claim 1, further comprising a pair of bushings connected to said collar, each of said bushings capturing and housing at least a portion of one of said spring-loaded pivot pins.

5. A replaceable nozzle tip assembly according to claim 3, wherein each of said pivot pins is spring-loaded by a pair of concentrically-positioned, oppositely-wound helical springs which are captured and housed within said bushings.

6. A tiltable coal nozzle tip assembly for a stationary coal nozzle utilized to discharge a stream of pulverized coal and air into a coal-fired furnace, comprising a collar having a pair of opposed, radially inward-extending, spring-loaded pivot pins which are resiliently biased radially inward and which are capable of removably connecting said tiltable nozzle tip to the stationary nozzle in a manner which permits pivoting of said tiltable nozzle tip in a vertical plane relative to the stationary nozzle for directing the stream of pulverized coal and air in any direction within a range of directions in said furnace, each of said pivot pins being resiliently biased radially inward by a spring means so that said pivot pins secure said collar to the stationary coal nozzle, and said spring means permitting said pivot pins to be urged radially outward so that said collar is capable of being installed on, and removed from, the coal nozzle.

7. A tiltable coal nozzle tip assembly according to claim 6, having a radially outward-extending link pin; and further comprising a link arm extending from said nozzle tip for pivoting the coal nozzle tip relative to the stationary coal nozzle in a vertical plane, said link arm having a hook-shaped distal end which is capable of removably securing said link arm to said link pin.

8. A tiltable coal nozzle tip assembly according to claim 6, wherein each of said spring means comprises a pair of concentrically-positioned, oppositely-wound helical springs.

9. A tiltable coal nozzle tip assembly according to claim 8, further comprising a pair of bushings integrally connected to said collar, each bushing capturing one of said spring means and at least a head portion of one of said pivot pins.

10. A coal nozzle assembly for discharging a stream of pulverized coal and air into a coal-fired furnace, comprising:

a stationary open-ended conduit having a furnace-side end defining a discharge port and two opposed tip-attaching apertures spaced from said discharge port;

a replaceable coal nozzle tip having a seal plate capable of being telescopically received on said furnace-side end of said stationary conduit; and a pair of opposed spring-loaded pivot pins extending radially inward through said seal plate and capable of cooperatively engaging said apertures on said stationary conduit for removably securing said coal nozzle tip to said furnace-side end of said stationary conduit, each of said spring-loaded pivot pins being resiliently biased radially inward by a spring means and capable of being urged radially outward so that said coal nozzle tip and seal plate are capable of being installed on, and removed from, said stationary conduit.

11. A coal nozzle assembly according to claim 10, wherein said coal nozzle tip has a radially outward-extending link pin; and further comprising a link arm extending from said coal nozzle tip for pivoting said coal nozzle tip relative to said stationary conduit in a vertical plane, said link arm having a hook-shaped end which is capable of removably securing said link arm to said coal nozzle tip.

12. A coal nozzle assembly according to claim 11, wherein each of said spring means comprises a pair of concentrically-positioned, oppositely-wound helical springs.

13. A coal nozzle assembly according to claim 10, further comprising a pair of bushings integrally connected to said coal nozzle tip, wherein each of said bushing captures and houses a head portion of one of said pivot pins and one of said spring means.

14. A coal nozzle assembly according to claim 13, wherein the seal plate has a pair of opposite openings respectively receiving said bushings, and in which the seal plate is retained by, and pivoted on, said bushings.

15. A coal nozzle assembly according to claim 10, wherein said replaceable coal nozzle tip is composed of a material selected from the group consisting of fabricated material and cast material.

16. A method of installing a replaceable tip on a stationary coal nozzle pre-installed in a furnace and having a longitudinal axis and a furnace-side end defining a discharge port within the furnace, comprising the steps of:

locating said replaceable tip within the furnace adjacent the furnace-side end of the pre-installed stationary coal nozzle, said tip having a pair of opposed, radially inward-extending, spring-loaded pivot pins which are resiliently biased toward each other in a radially inward direction relative to said longitudinal axis of the stationary coal nozzle; and urging said spring-loaded pivot pins away from each other in a radially outward direction, and telescopically advancing said tip onto the furnace side end of the pre-installed stationary coal nozzle until said spring loaded pivot pins snap inwardly into engagement with a pair of apertures formed in the stationary coal nozzle.

17. A method according to claim 16, further comprising the step of connecting a pre-installed link arm to said tip, and utilizing said link arm to tilt said tip relative to the stationary coal nozzle in a vertical plane so that said tip is capable of directing a discharge of a stream of pulverized coal and air into the furnace in any direction within a range of directions.

18. A method according to claim 17, in which the link arm is connected to said tip by engaging a hook-shaped distal end of the link arm with a radially extending link pin on said tip.

19. A method according to claim 18, in which the link arm has a downwardly open slot and is engaged with the link pin by lifting the link arm so that it extends over the link pin and moving the link pin until it is engaged in said downwardly open slot.

20. A method according to claim 16, further comprising the step of utilizing a spreader tool to urge said pair of pivot pins radially outward.

21. A method of removing a replaceable tip from a stationary coal nozzle installed in a coal-fired furnace and having a furnace-side end defining a discharge port within the furnace, wherein said replaceable tip is connected to the furnace-side end of the installed stationary coal nozzle by a pair of opposed, radially inward-extending, spring-loaded pivot pins which are resiliently biased radially into a pair of apertures on the stationary coal nozzle, comprising the steps of:

urging said pair of spring-loaded pivot pins radially outward so that they clear said apertures; and withdrawing said tip is telescopically withdrawn from the furnace side end of the installed stationary coal nozzle.

22. A method according to claim 21, wherein said tip is connected to a link arm utilized to tilt said tip in a vertical plane relative to the stationary coal nozzle, said tip having a radially extending link pin and said link arm having a hook-shaped distal end which is cooperatively engageable with said link pin, comprising the steps of unhooking said link arm from said link pin to disengage said link arm from said tip and lifting said disengaged link arm relative to the furnace side end of the installed stationary coal nozzle before the tip is telescopically withdrawn from the furnace-side end of the installed stationary coal nozzle.

23. A method according to claim 21, further comprising the step of utilizing a spreader tool to urge said pair of pivot pins radially outward.

* * * * *